US008299998B2

(12) United States Patent
Lee

(10) Patent No.: US 8,299,998 B2
(45) Date of Patent: Oct. 30, 2012

(54) LIQUID CRYSTAL DISPLAY DEVICE WITH FIRST AND SECOND IMAGE SIGNALS ABOUT A MIDDLE VOLTAGE

(75) Inventor: Ju Young Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 706 days.

(21) Appl. No.: 12/318,041

(22) Filed: Dec. 19, 2008

(65) Prior Publication Data

US 2009/0160832 A1 Jun. 25, 2009

(30) Foreign Application Priority Data

Dec. 20, 2007 (KR) ..... 10-2007-0134222

(51) Int. Cl.
*G09G 3/36* (2006.01)

(52) U.S. Cl. ..... 345/92

(58) Field of Classification Search ..... 345/204–205, 345/208–210, 87–96; 349/37–47
See application file for complete search history.

(56) References Cited

U.S. PATENT DOCUMENTS 6,704,066 B2 * 3/2004 Tsumura et al. ..... 349/42
7,586,550 B2 * 9/2009 Kim et al. ..... 349/39
2004/0085503 A1 5/2004 Kim et al.

FOREIGN PATENT DOCUMENTS

JP 06148596 A * 5/1994

* cited by examiner

*Primary Examiner* — Liliana Cerullo
(74) *Attorney, Agent, or Firm* — McKenna Long & Aldridge, LLP

(57) ABSTRACT

Disclosed herein are a liquid crystal display device which is capable of driving a liquid crystal using image signals supplied to two adjacent data lines, and a driving method thereof. The liquid crystal display device has a plurality of liquid crystal cells formed respectively in pixel areas defined by crossings of a plurality of gate lines and a plurality of data lines. Each of the liquid crystal cells includes a thin film transistor connected to any one of the gate lines and any one of the data lines, and a liquid crystal capacitor and a storage capacitor each formed between a data line adjacent thereto, among the data lines, and the thin film transistor. The thin film transistors of the liquid crystal cells are alternately arranged between and alternately connected to every two vertically adjacent ones of the gate lines along the gate lines.

18 Claims, 11 Drawing Sheets

LIQUID CRYSTAL DISPLAY DEVICE WITH FIRST AND SECOND IMAGE SIGNALS ABOUT A MIDDLE VOLTAGE

This application claims the benefit of Korean Patent Application No. P2007-134222, filed on Dec. 20, 2007, which is hereby incorporated by reference for all purposes as if fully set forth herein.

BACKGROUND OF THE INVENTION

1. Field of the Invention

The present invention relates to a liquid crystal display device, and more particularly, to a liquid crystal display device which is capable of driving a liquid crystal using image signals supplied to two adjacent data lines, and a driving method thereof.

2. Discussion of the Related Art

Generally, a related art liquid crystal display device is adapted to display an image by adjusting light transmittance of a liquid crystal using an electric field. To this end, the liquid crystal display device comprises a liquid crystal panel including liquid crystal cells arranged in a matrix form between two glass substrates, each having a liquid crystal formed between the glass substrates and switching elements for switching signals to be supplied to the liquid crystal cells, respectively, a driving circuit for driving the liquid crystal panel, and a backlight unit for irradiating light to the liquid crystal panel.

Each of the liquid crystal cells of the liquid crystal panel adjusts light transmittance of the liquid crystal based on an electric field formed by a potential difference between an image signal supplied to a corresponding data line and a common voltage applied to an opposite electrode.

However, the related art liquid crystal display device has problems as follows.

First, a common voltage supply line is required to apply the common voltage to the opposite electrode of each liquid crystal cell, resulting in a reduction in aperture ratio of each liquid crystal cell.

Second, because a flicker occurs due to a kickback voltage $\Delta Vp$ resulting from a parasitic capacitance of each liquid crystal cell, the common voltage must be adjusted to remove the flicker.

Third, a picture quality is degraded due to a horizontal crosstalk resulting from a distortion of the common voltage based on the position of each liquid crystal cell.

Fourth, a voltage of a direct current (DC) offset component is applied to the liquid crystal due to the kickback voltage, resulting in a deterioration of the liquid crystal.

Fifth, an afterimage is generated due to a polarity inversion of each liquid crystal cell based on an inversion scheme. That is, in order to reduce the DC offset component and, in turn, the deterioration of the liquid crystal, the related art liquid crystal display device is driven in the inversion scheme where the polarity is inverted between adjacent liquid crystal cells and on a frame period basis. However, when any one of two polarities of a data voltage is dominantly supplied for a lengthy period of time, an afterimage in which the pattern of the original image appears faintly is generated. This afterimage is called "DC image sticking" in that a voltage of the same polarity is repetitively charged in the liquid crystal cell.

Sixth, because the voltage level of an image signal is divided into a positive polarity and a negative polarity on the basis of the common voltage, the image signal has a large swing width based on the polarities, thereby increasing the amount of heat to be generated in a data driving circuit and the amount of current to be consumed therein.

SUMMARY OF THE INVENTION

Accordingly, the present invention is directed to a liquid crystal display device and a driving method thereof that substantially obviate one or more problems due to limitations and disadvantages of the related art.

An advantage of the present invention is to provide a liquid crystal display device which is capable of driving a liquid crystal using image signals supplied to two adjacent data lines, and a driving method thereof.

Additional advantages, and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages in accordance with the purpose of the invention, as embodied and broadly described herein, a liquid crystal display device has a plurality of liquid crystal cells formed respectively in pixel areas defined by crossings of a plurality of gate lines and a plurality of data lines, wherein each of the liquid crystal cells comprises: a thin film transistor connected to any one of the gate lines and any one of the data lines; and a liquid crystal capacitor and a storage capacitor each formed between a data line adjacent thereto, among the data lines, and the thin film transistor, wherein the thin film transistors of the liquid crystal cells are alternately arranged between and alternately connected to every two vertically adjacent ones of the gate lines along the gate lines.

In another aspect of the present invention, a liquid crystal display device has a plurality of liquid crystal cells formed respectively in pixel areas defined by crossings of a plurality of gate lines and a plurality of data lines, wherein each of the liquid crystal cells is connected to two data lines adjacent respectively to left and right sides thereof, among the data lines, and one unit pixel is constituted by every first to third ones of the liquid crystal cells, arranged adjacent to one another in a direction of the gate lines, wherein any one of the liquid crystal cells of the unit pixel is connected to a gate line different from that to which the other liquid crystal cells of the unit pixel are connected.

In another aspect of the present invention, a liquid crystal display device comprises: an image display panel including a plurality of liquid crystal cells formed respectively in pixel areas defined by intersections of a plurality of gate lines and a plurality of data lines, each of the liquid crystal cells being driven by first and second image signals supplied respectively to two data lines adjacent respectively to left and right sides thereof, among the data lines; a gate driving circuit for driving the gate lines; a data driving circuit for converting the same data into the first and second image signals, the first and second image signals having voltage levels symmetrical to each other, and supplying the converted first and second image signals to each of the liquid crystal cells, respectively, through the two adjacent data lines; and a timing controller for controlling the gate driving circuit and the data driving circuit and supplying the data corresponding to the first and second image signals to the data driving circuit, wherein the first and second image signals are symmetrical about a middle voltage between a lowest voltage and a highest voltage.

In another aspect of the present invention, a method for driving a liquid crystal display device, where the liquid crystal display device has a plurality of liquid crystal cells formed respectively in pixel areas defined by crossings of a plurality of gate lines and a plurality of data lines, comprises: sequentially driving the gate lines; converting the same data into first and second image signals, the first and second image signals being symmetrical about a middle voltage between a lowest voltage and a highest voltage; and supplying the first and second image signals to each of the liquid crystal cells, respectively, through two data lines adjacent respectively to left and right sides thereof, among the data lines, synchronously with the driving of a corresponding one of the gate lines.

In a further aspect of the present invention, a method for driving a liquid crystal display device, where the liquid crystal display device has a plurality of liquid crystal cells formed respectively in pixel areas defined by intersections of a plurality of gate lines and a plurality of data lines and one unit pixel is constituted by every first to third ones of the liquid crystal cells, arranged adjacent to one another in a direction of the gate lines, comprises: sequentially driving the gate lines; converting the same data into first and second image signals, the first and second image signals being symmetrical about a middle voltage between a lowest voltage and a highest voltage; and supplying the first and second image signals to each of one or some of the liquid crystal cells of the unit pixel, respectively, through two data lines adjacent respectively to left and right sides thereof, among the data lines, synchronously with the driving of a first one of two gate lines adjacent respectively to upper and lower sides of the unit pixel, among the gate lines, and supplying the first and second image signals to each of the other liquid crystal cells or the other liquid crystal cell of the unit pixel, respectively, through two data lines adjacent respectively to left and right sides thereof, among the data lines, synchronously with the driving of a second one of the two adjacent gate lines.

The step of converting comprises: generating a plurality of positive gamma voltages having different voltage levels higher than the middle voltage; generating a plurality of negative gamma voltages having different voltage levels lower than the middle voltage, the negative gamma voltages being symmetrical to the positive gamma voltages with respect to the middle voltage; sampling the data; and converting the sampled data into the first and second image signals in response to a polarity control signal using the positive gamma voltages and the negative gamma voltages.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
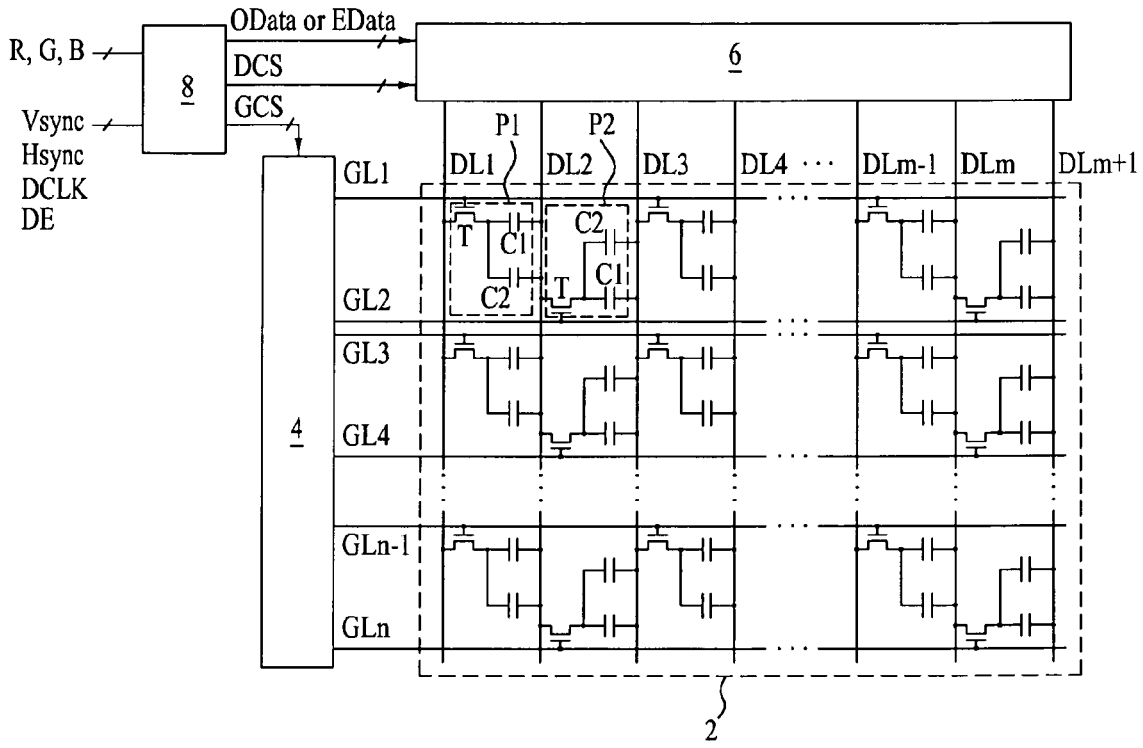
FIG. 1 is a schematic view of a liquid crystal display device according to a first embodiment of the present invention.
Figure 2:
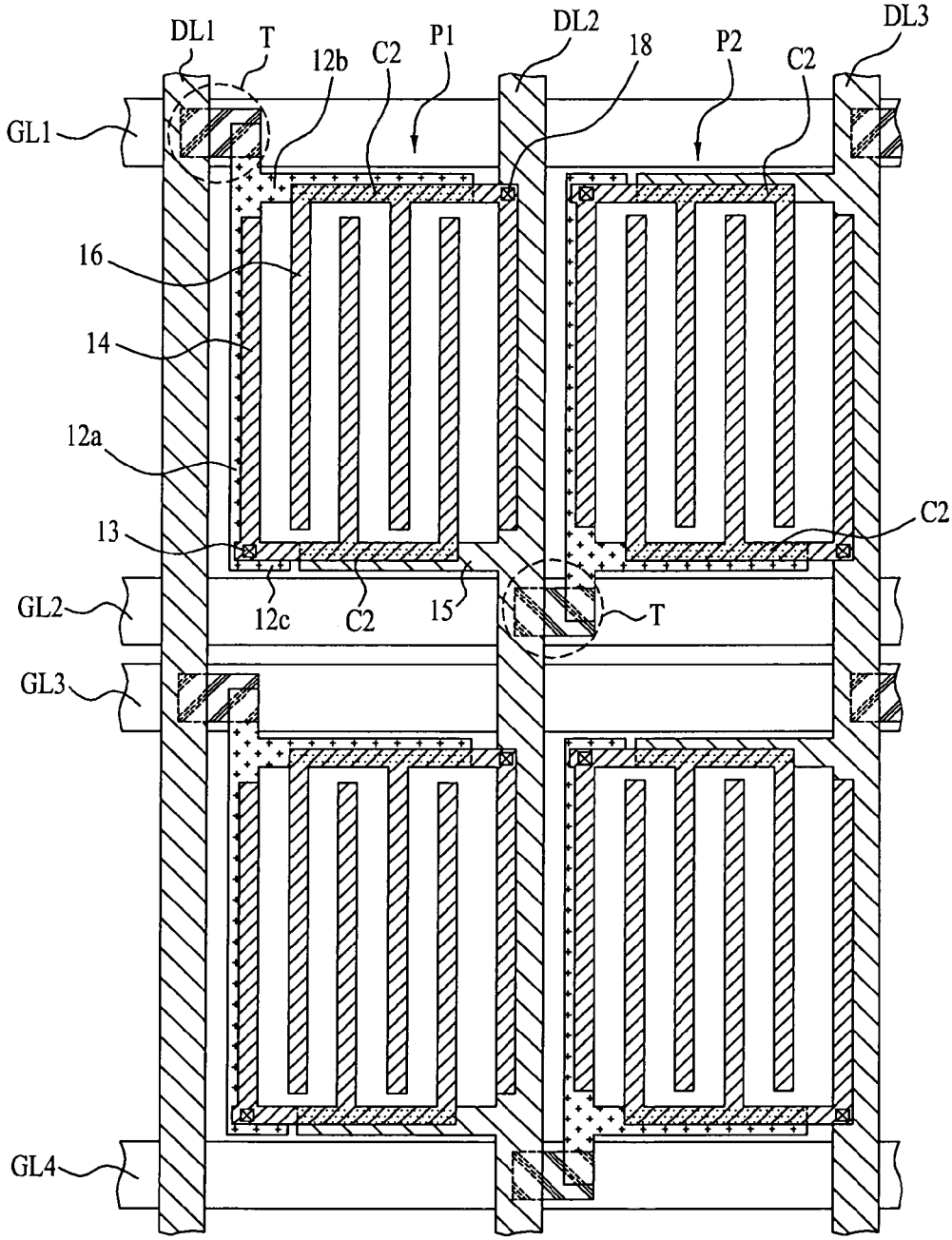
FIG. 2 is a plan view showing a layout of liquid crystal cells formed in an image display panel shown in FIG. 1.

FIG. 1 is a schematic view of a liquid crystal display device according to a first embodiment of the present invention, and FIG. 2 is a plan view showing a layout of liquid crystal cells formed in an image display panel shown in FIG. 1.

Referring to FIGS. 1 and 2, the liquid crystal display device according to the first embodiment of the present invention comprises an image display panel 2 including a plurality of liquid crystal cells P formed respectively in pixel areas defined by m+1 data lines DL1 to DLm+1 and n gate lines GL1 to GLn, each adapted for driving a liquid crystal based on image signals supplied to two data lines adjacent respectively to the left and right sides thereof, among the data lines DL1 to DLm+1, a gate driving circuit 4 for driving the gate lines GL1 to GLn, a data driving circuit 6 for supplying an image signal to each of the data lines DL1 to DLm+1, and a timing controller 8 for supplying a data signal to the data driving circuit 6 and controlling the gate and data driving circuits 4 and 6.

Each liquid crystal cell P includes a thin film transistor T connected to any one of the n gate lines GL1 to GLn and any one of the m+1 data lines DL1 to DLm+1, and a liquid crystal capacitor C1 and a storage capacitor C2 each formed between the thin film transistor T and a data line DL adjacent thereto, among the data lines DL1 to DLm+1.

The thin film transistors T of the liquid crystal cells P are alternately arranged between every two vertically adjacent ones GL of the gate lines GL1 to GLn along the gate lines GL. Three liquid crystal cells adjacent along the gate lines GL, namely, red, green and blue liquid crystal cells constitute one unit pixel.

In detail, the thin film transistors T of odd ones (referred to hereinafter as a "first liquid crystal cell group") P1 of the liquid crystal cells P on horizontal lines corresponding to the direction of the gate lines GL are connected respectively to the odd gate lines GL1, GL3, GL5, . . . , GLn−1 and the odd data lines DL1, DL3, DL5, . . . , DLm−1, except the (m+1)th data line DLm+1. Also, the thin film transistors T of even ones (referred to hereinafter as a "second liquid crystal cell group") P2 of the liquid crystal cells P on the horizontal lines are connected respectively to the even gate lines GL2, GL4, GL6, . . . , GLn and the even data lines DL2, DL4, DL6, . . . , DLm.

Each liquid crystal cell of the first liquid crystal cell group P1 includes a thin film transistor T including a semiconductor layer overlapping a corresponding one of the odd gate lines GL1, GL3, GL5, . . . , GLn−1 and having one side formed to partially overlap a corresponding one of the odd data lines DL1, DL3, DL5, . . . , DLm−1, and a drain electrode formed to overlap the other side of the semiconductor layer, a pixel electrode 14 connected to the drain electrode via a first contact hole 13, an opposite electrode 16 connected to an adjacent one of the even data lines DL2, DL4, DL6, . . . , DLm via a second contact hole 18 and formed to partially overlap the pixel electrode 14, and a protrusion electrode 15 protruded from the adjacent even data line to partially overlap the pixel electrode 14.

The data line DL overlapped by the one side of the semiconductor layer acts as a source electrode of the thin film transistor T.

The drain electrode of the thin film transistor T includes a vertical portion 12*a* formed to overlap the other side of the semiconductor layer and arranged in parallel with the corresponding odd data line while being spaced apart from the corresponding odd data line by a predetermined distance, a first horizontal portion 12*b* protruded from the top of the vertical portion 12*a* and arranged in parallel with the corresponding odd gate line while being spaced apart from the corresponding odd gate line by a predetermined distance, and a second horizontal portion 12*c* protruded from the bottom of the vertical portion 12*a* and arranged in parallel with a corresponding one of the even gate lines GL2, GL4, GL6, . . . , GLn while being spaced apart from the corresponding even gate line by a predetermined distance. Here, the first horizontal portion 12*b* is protruded longer than the second horizontal portion 12*c* such that it is adjacent to the adjacent even data line, and the second horizontal portion 12*c* is protruded shorter than the first horizontal portion 12*b* such that it is adjacent to the protrusion electrode 15. Alternatively, the second horizontal portion 12*c* may not be formed.

The pixel electrode 14 is electrically connected to the drain electrode via the first contact hole 13, which is formed in a bent portion between the ('□1' □□) vertical portion 12*a* of the drain electrode and the second horizontal portion 12*c* of the drain electrode. The pixel electrode 14 includes a first body overlapping the second horizontal portion 12*c* of the drain electrode and the protrusion electrode 15 via a protection film (not shown), and a plurality of first wings protruded from the first body by a predetermined distance from the first body. Here, the plurality of first wings are arranged in parallel at regular intervals and each have at least one of a bent shape, curved shape and straight line shape. Any one of the plurality of first wings may overlap the vertical portion 12*a* of the drain electrode.

The opposite electrode 16 is electrically connected to the adjacent even data line via the second contact hole 18. The opposite electrode 16 includes a second body overlapping the first horizontal portion 12*b* of the drain electrode via a protection film, and a plurality of second wings protruded from the second body toward the first body of the pixel electrode 14. Here, each of the plurality of second wings has the same shape as that of each of the plurality of first wings and is disposed between adjacent ones of the plurality of first wings. Any one of the plurality of second wings may overlap the adjacent even data line.

The liquid crystal capacitor C1 is formed by a liquid crystal layer between the pixel electrode 14 and the opposite electrode 16.

The storage capacitor C2 includes a first storage capacitor formed by an overlap of the first horizontal portion 12*b* of the drain electrode and the second body of the opposite electrode 16, and a second storage capacitor formed by an overlap of the first body of the pixel electrode 14 and the protrusion electrode 15.

On the other hand, each liquid crystal cell of the second liquid crystal cell group P2 is formed to have the same configuration as that of each liquid crystal cell of the first liquid crystal cell group P1, with the exception that the semiconductor layer of the thin film transistor T is formed on a corresponding one of the even gate lines GL2, GL4, GL6, . . . , GLn.

Each liquid crystal capacitor C1 of the first liquid crystal cell group P1 drives a liquid crystal by forming a horizontal electric field based on a potential difference between a first image signal from a corresponding one of the odd data lines DL1, DL3, DL5, . . . , DLm−1, except the (m+1)th data line DLm+1, and a second image signal from a corresponding one of the even data lines DL2, DL4, DL6, . . . , DLm. At this time, the second image signal which is supplied from each of the even data lines DL2, DL4, DL6, . . . , DLm to the opposite electrode is a reference voltage to drive the first liquid crystal cell group P1. Each storage capacitor C2 of the first liquid crystal cell group P1 stores the potential difference between the first image signal and the second image signal when the first liquid crystal cell group P1 is driven, so as to maintain a voltage stored in each liquid crystal capacitor C1 of the first liquid crystal cell group P1 after the thin film transistor T is turned off.

Also, each liquid crystal capacitor C1 of the second liquid crystal cell group P2 drives a liquid crystal by forming an electric field based on a potential difference between a first image signal which is supplied from a corresponding one of the even data lines DL2, DL4, DL6, . . . , DLm to the pixel electrode 14 and a second image signal which is supplied from a corresponding one of the odd data lines DL3, DL5, . . . , DLm+1, except the first data line DL1, to the opposite electrode 16. At this time, the second image signal which is supplied from each of the odd data lines DL3, DL5, . . . , DLm+1, except the first data line DL1, to the opposite electrode 16 is a reference voltage to drive the second liquid crystal cell group P2. Each storage capacitor C2 of the second liquid crystal cell group P2 stores the potential difference between the first image signal and the second image signal when the second liquid crystal cell group P2 is driven, so as to maintain a voltage stored in each liquid crystal capacitor C1 of the second liquid crystal cell group P2 after the thin film transistor T is turned off.

Figure 3:
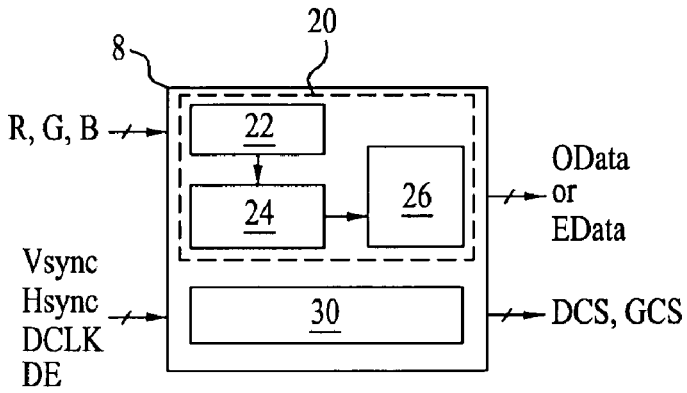
FIG. 3 is a schematic block diagram of a timing controller shown in FIG. 1.

The timing controller 8 includes, as shown in FIG. 3, a data arranger 20 for arranging input data signals R, G and B into odd data OData and even data EData and supplying the arranged odd data OData and even data EData to the data driving circuit 6, and a control signal generator 30 for generating gate and data control signals GCS and DCS using synchronous signals.

The control signal generator 30 generates the gate control signal GCS for supply of a gate pulse to each gate line GL of the image display panel 2 using at least one of a dot clock DCLK, a data enable signal DE and vertical and horizontal synchronous signals Vsync and Hsync from the outside. Here, the gate control signal GCS includes a gate start pulse GSP, gate shift clock GSC and gate output enable signal GOE to control a driving timing of the gate driving circuit 4.

Also, the control signal generator 30 generates the data control signal DCS for supply of an image signal to each data line DL of the image display panel 2 using at least one of the dot clock DCLK, the data enable signal DE and the vertical and horizontal synchronous signals Vsync and Hsync from the outside. Here, the data control signal DCS includes a source output enable signal SOE, source shift clock SSC, source start pulse SSP and polarity control signal POL to control a driving timing of the data driving circuit 6.

The data arranger 20 includes a data separator 22, data storage unit 24, and data output unit 26.

Figure 4:
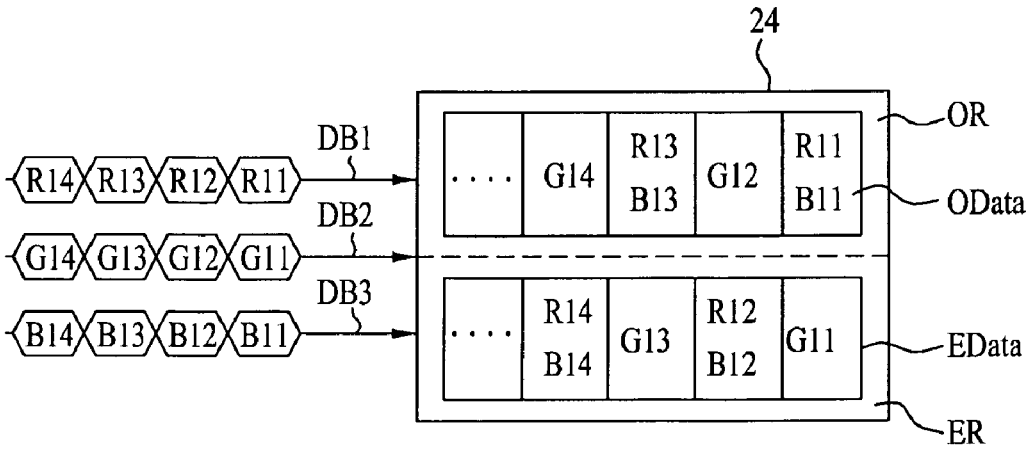
FIG. 4 is a view illustrating odd and even data stored in a data storage unit shown in FIG. 3.

The data separator 22 receives red, green and blue data signals R, G and B inputted over three data bus lines DB1, DB2 and DB3, separates each of the received red, green and blue data signals R, G and B into odd data OData and even data EData corresponding to an array structure of the liquid crystal cells in the image display panel 2, and stores the separated odd data OData and even data EData in the data storage unit 24, as shown in FIG. 4. For example, the data separator 22 stores odd data OData: R11, B11, G12, R13, B13, G14, . . . , Bnm to be supplied to the first liquid crystal cell group P1, among the inputted data signals R, G and B, in an odd data region OR of the data storage unit 24, and stores even data EData: G11, R12, B12, G13, R14, B14, . . . , Gnm to be supplied to the second liquid crystal cell group P2, among the inputted data signals R, G and B, in an even data region ER of the data storage unit 24.

The data output unit 26 changes the output order of the odd data OData and even data EData stored respectively in the odd and even data regions OR and ER of the data storage unit 24 using the dot clock DCLK or a clock internally generated by the timing controller 8 such that the odd data OData and even data EData correspond to the number of data bus lines between the timing controller 8 and the data driving circuit 6, and supplies the odd data OData and even data EData to the data driving circuit 6 in the changed output order.

Figure 5A:
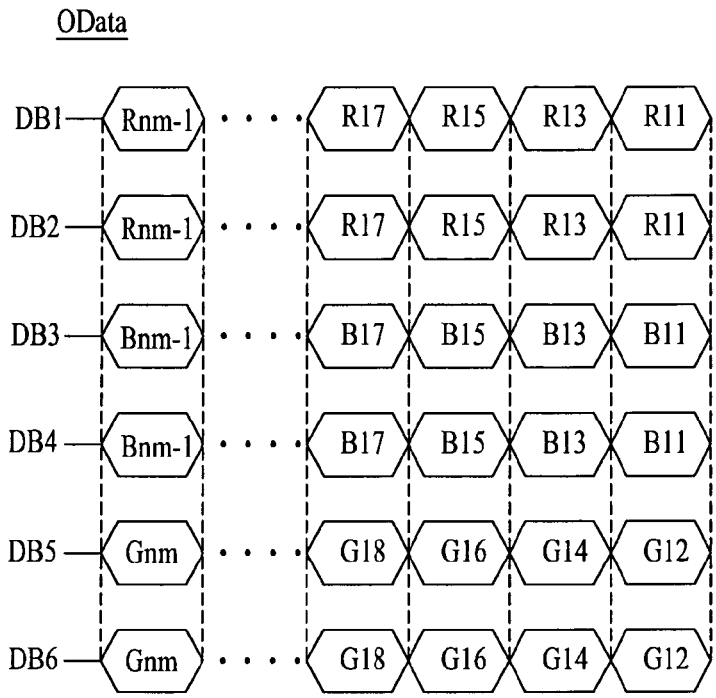
FIGS. 5A and 5B are views illustrating odd and even data output from a data output unit shown in FIG. 3.

In detail, the data output unit 26 outputs odd data OData or even data EData to be supplied to each liquid crystal cell to both two data bus lines. At this time, the data outputted to any one of the two data bus lines is data for generation of the first image signal, and the data outputted to the other data bus line is data for generation of the second image signal. For example, in the first liquid crystal cell of the red color connected to the first and second data lines and the first gate line, the data output unit 26 outputs the red odd data R11 to be supplied to the first liquid crystal cell of the red color to both first and second data bus lines. Consequently, the data output unit 26 changes the output order of odd data OData as shown in FIG. 5A such that the odd data OData corresponds to an arranged position of the first liquid crystal cell group P1 in the image display panel 2, and outputs the odd data OData to six data bus lines DB1 to DB6 in the changed output order. Similarly, the data output unit 26 changes the output order of even data EData as shown in FIG. 5B such that the even data EData corresponds to an arranged position of the second liquid crystal cell group P2 in the image display panel 2, and outputs the even data EData to the six data bus lines DB1 to DB6 in the changed output order.

In FIG. 1, the gate driving circuit 4 generates a gate pulse in response to the gate control signal GCS supplied from the timing controller 8 and supplies the generated gate pulse sequentially to the gate lines GL. As a result, the gate lines GL of the image display panel 2 are sequentially driven by the gate pulse from the gate driving circuit 4. On the other hand, the gate driving circuit 4 may be formed on a substrate on which the image display panel 2 is formed and be connected to the gate lines GL, at the same time that a manufacturing process of the thin film transistor is performed.

Figure 6:
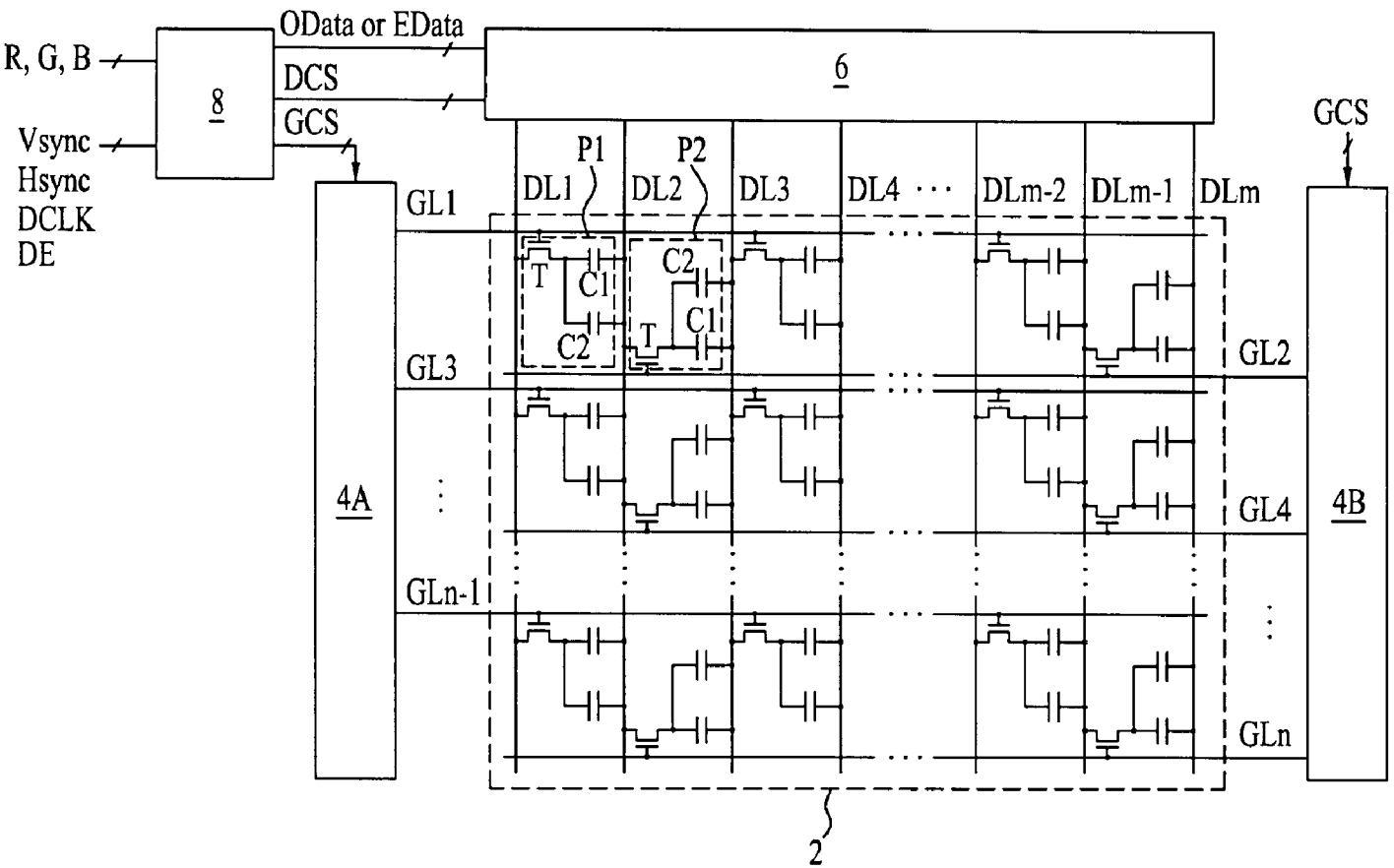
FIG. 6 is a schematic view of another configuration of the liquid crystal display device according to the first embodiment of the present invention.

This gate driving circuit 4 is disposed at one side of the image display panel 2 and connected to one ends of the gate lines GL, as shown in FIG. 1. Alternatively, the gate driving circuit 4 may include first and second gate driving circuits 4A and 4B disposed at both ends of the image display panel 2 and connected to both ends of the gate lines GL, respectively, as shown in FIG. 6. In this case, the first gate driving circuit 4A supplies the gate pulse sequentially to the odd gate lines GL1, GL3, GL5, . . . , GLn−1, among the gate lines GL, and the second gate driving circuit 4B supplies the gate pulse sequentially to the even gate lines GL2, GL4, GL6, . . . , GLn, among the gate lines GL.

Figure 5B:
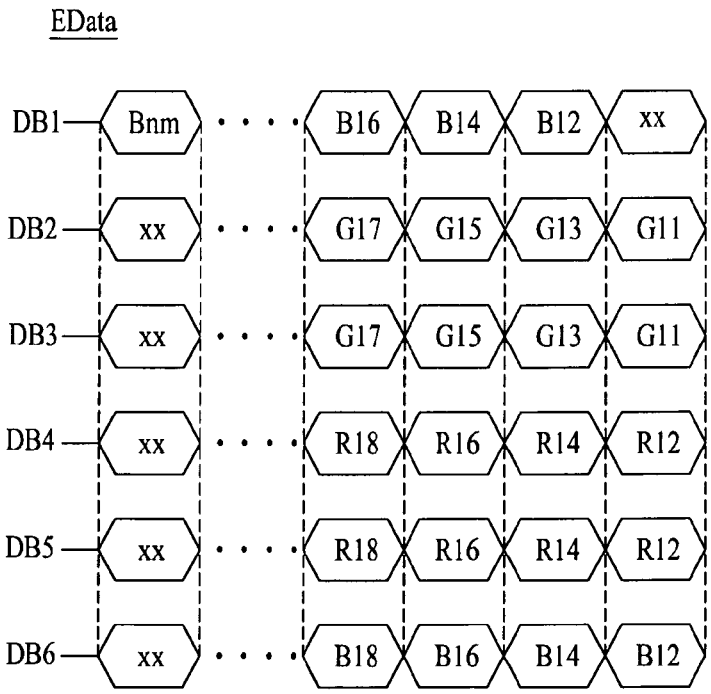

The data driving circuit 6 samples odd data OData or even data EData of one horizontal line, supplied from the timing controller 8 over the data bus lines as shown in FIGS. 5A or 5B, using the data control signal DCS supplied from the timing controller 8, converts the sampled data into positive image signals or negative image signals using a plurality of gamma voltages and the polarity control signal and supplies the converted positive or negative image signals to the data lines.

Here, the plurality of gamma voltages include a plurality of positive (+) gamma voltages and a plurality of negative (−) gamma voltages which are symmetrical about a middle voltage between a lowest voltage and a highest voltage. For example, in the case where the lowest voltage is 0V and the highest voltage is 8V, the plurality of positive (+) gamma voltages have different voltage levels within the range of more than 4V which is the middle voltage, but not more than 8V, and the plurality of negative (−) gamma voltages have different voltage levels within the range from 0V to less than 4V. Here, 0V may be a negative white voltage and 8V may be a positive white voltage. As a result, sampled data is converted into a positive first image signal or negative first image signal or converted into a positive second image signal or negative second image signal.

Because the first and second image signals which are supplied to each liquid crystal cell P are symmetrical about the middle voltage as stated above, the liquid crystal of each liquid crystal cell P can be driven with a high voltage. For example, for display of a positive white image on a liquid crystal cell, conventionally, a common voltage of 4V is supplied to an opposite electrode through a common voltage supply line and a positive data voltage of 8V is applied to a pixel electrode through a data line, so that the positive white image is displayed using a potential difference of 4V. In contrast, in the present invention, a positive first image signal of 8V is supplied to a pixel electrode through a first data line and a negative second image signal of 0V is supplied to an opposite electrode through a second data line, so that the positive white image is displayed using a potential difference of 8V. Consequently, according to the present invention, the positive white image is displayed using the potential difference of 8V, thereby making it possible to drive the liquid crystal with a high voltage compared with a conventional one, so as to increase a response speed of the liquid crystal. In addition, in the case where the liquid crystal driving voltage of the present invention is made to be equal to a conventional one, the present invention can reduce power consumption.

FIGS. 7A to 7D are views stepwise illustrating the polarities of image signals supplied to the image display panel and the polarities of the liquid crystal cells of the image display panel, in a driving method of the liquid crystal display device according to the first embodiment of the present invention. FIGS. 7A to 7D show only liquid crystal cells to which image signals are supplied.

Figure 7A:
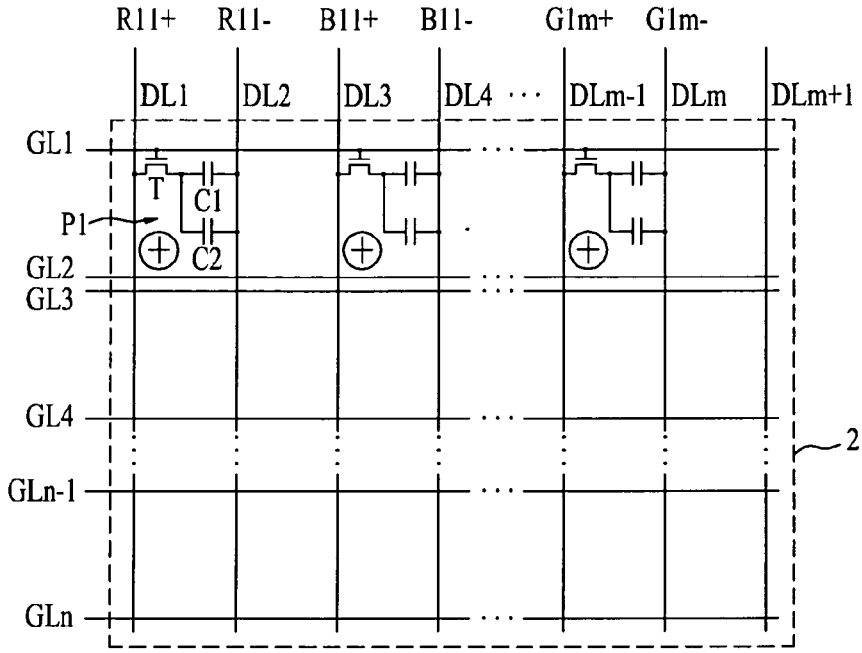
FIGS. 7A to 7D are views illustrating a driving method of the liquid crystal display device according to the first embodiment of the present invention.

First, the gate pulse is supplied to the first gate line GL1 by the gate driving circuit 4. In synchronization with this, the data driving circuit 6 supplies positive (+) first image signals R11+, B11+, . . . , G1*m*+ respectively to the odd data lines DL1, DL3, DL5, . . . , DLm−1, except the (m+1)th data line DLm+1, and supplies negative (−) second image signals R11−, B1−, . . . , G1*m*− respectively to the even data lines DL2, DL4, DL6, . . . , DLm, as shown in FIG. 7A. As a result, each liquid crystal cell of the first liquid crystal cell group P1 of the first horizontal line displays an image by driving the liquid crystal with a positive electric field based on a potential difference of the first image signal from the second image signal supplied to the opposite electrode. Hereinafter, the image displayed by the positive electric field will be referred to as a "positive image". For example, in the case where a first image signal of 8V is supplied to the first data line DL1 and, at the same time, a second image signal of 0V is supplied to the second data line DL2, the first liquid crystal cell forms a positive electric field to display a positive image (+), because the data voltage of 8V is higher than the reference voltage of 0V.

Figure 7B:
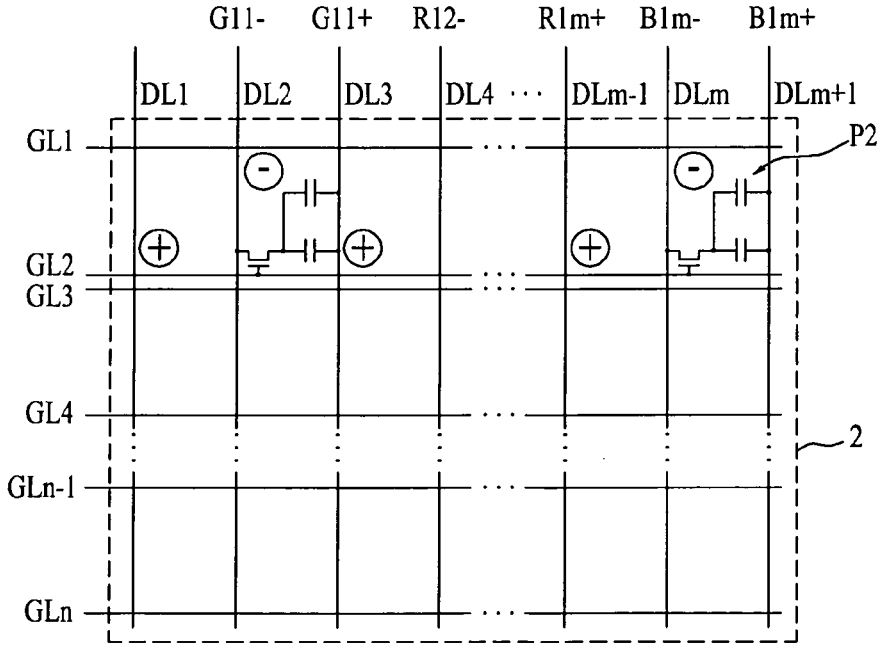

Thereafter, the gate pulse is supplied to the second gate line GL2 by the gate driving circuit 4. In synchronization with this, the data driving circuit 6 supplies negative (−) first image signals G11−, R12−, . . . , B1*m*− respectively to the even data lines DL2, DL4, DL6, . . . , DLm and supplies positive (+) second image signals G11+, R12+, . . . , B1*m*+ respectively to the odd data lines DL3, DL5, . . . , DLm+1, except the first data line DL1, as shown in FIG. 7B. At this time, although the negative (−) first image signals G11−, R12−, . . . , B1*m*− are supplied to the even data lines DL2, DL4, DL6, . . . , DLm, a potential difference charged in each liquid crystal cell P of the first liquid crystal cell group P1 is maintained as it is. That is, because the pixel electrode of each liquid crystal cell P is in a floating state, the voltage of the pixel electrode varies similarly to a voltage variation of the storage capacitor C2 according to characteristics of the capacitor. As a result, the potential difference charged in each liquid crystal cell P is maintained as it is.

Consequently, each liquid crystal cell of the second liquid crystal cell group P2 of the first horizontal line displays an image by driving the liquid crystal with a negative electric field based on a potential difference of the first image signal from the second image signal supplied to the opposite electrode. Hereinafter, the image displayed by the negative electric field will be referred to as a "negative image". For example, in the case where a first image signal of 0V is supplied to the second data line DL2 and, at the same time, a second image signal of 8V is supplied to the third data line DL3, the second liquid crystal cell forms a negative electric field to display a negative image (−), because the data voltage of 0V is lower than the reference voltage of 8V.

By displaying a negative image (−) on the second liquid crystal cell group P2 of the first horizontal line based on the driving of the second gate line GL2 after displaying a positive image (+) on the first liquid crystal cell group P1 of the first horizontal line based on the driving of the first gate line GL1, as stated above, the polarities of the liquid crystal cells of the first horizontal line are inverted for every liquid crystal cell. Also, by combining an image displayed on one or some of the liquid crystal cells of the unit pixel by the driving of the first gate line GL1 and an image displayed on the other liquid crystal cells or the other liquid crystal cell of the unit pixel by the driving of the second gate line GL2, a desired image is displayed on the unit pixel.

Figure 7C:
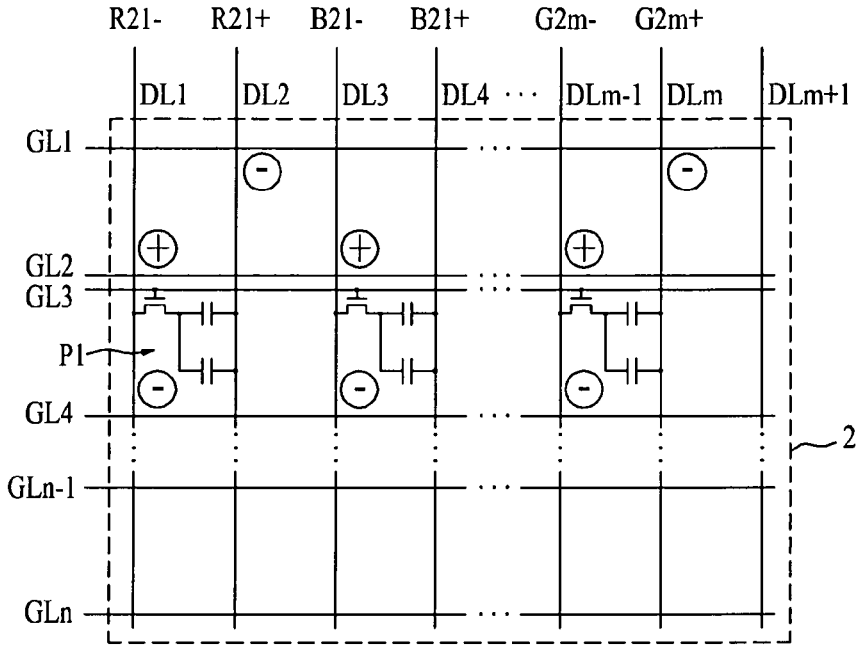

Thereafter, the gate pulse is supplied to the third gate line GL3 by the gate driving circuit 4. In synchronization with this, the data driving circuit 6 supplies negative (−) first image signals R21−, B21−, . . . , G2*m*− respectively to the odd data lines DL1, DL3, DL5, . . . , DLm−1, except the (m+1)th data line DLm+1, and supplies positive (+) second image signals R21+, B21+, . . . , G2*m*+ respectively to the even data lines DL2, DL4, DL6, . . . , DLm, as shown in FIG. 7C. As a result, each liquid crystal cell of the first liquid crystal cell group P1 of the second horizontal line displays a negative image (−) by driving the liquid crystal with a negative electric field based on a potential difference of the first image signal from the second image signal supplied to the opposite electrode.

Figure 7D:
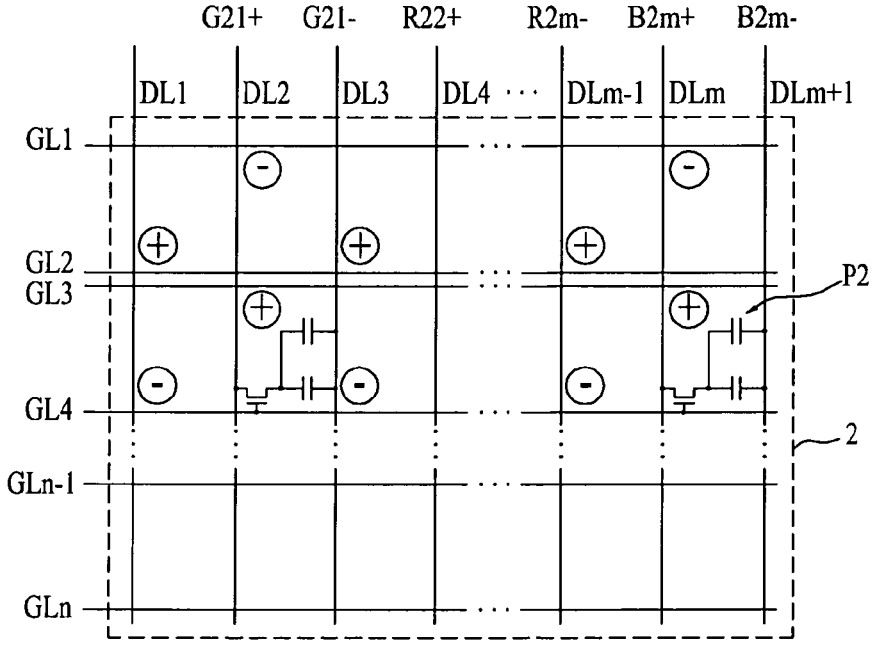

Thereafter, the gate pulse is supplied to the fourth gate line GL4 by the gate driving circuit 4. In synchronization with this, the data driving circuit 6 supplies positive (+) first image signals G21+, R22+, . . . , B2*m*+ respectively to the even data lines DL2, DL4, DL6, . . . , DLm and supplies negative (−) second image signals G21−, R22−, . . . , B2*m*− respectively to the odd data lines DL3, DL5, . . . , DLm+1, except the first data line DL1, as shown in FIG. 7D. As a result, each liquid crystal cell of the second liquid crystal cell group P2 of the second horizontal line displays a positive image (+) by driving the liquid crystal with a positive electric field based on a potential difference of the first image signal from the second image signal supplied to the opposite electrode.

By displaying a positive image (+) on the second liquid crystal cell group P2 of the second horizontal line based on the driving of the fourth gate line GL4 after displaying a negative image (−) on the first liquid crystal cell group P1 of the second horizontal line based on the driving of the third gate line GL3, as stated above, the polarities of the liquid crystal cells of the second horizontal line are inverted for every liquid crystal cell and become inverted ones of the polarities of the liquid crystal cells of the first horizontal line. Also, by combining an image displayed on one or some of the liquid crystal cells of the unit pixel by the driving of the third gate line GL3 and an image displayed on the other liquid crystal cells or the other liquid crystal cell of the unit pixel by the driving of the fourth gate line GL4, a desired image is displayed on the unit pixel.

The liquid crystal cells of the remaining horizontal lines corresponding to the fifth to nth gate lines GL5 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, in the liquid crystal display device and the driving method thereof according to the first embodiment of the present invention, first and second image signals having voltage levels symmetrical about a middle voltage are supplied to a liquid crystal cell connected to two data lines adjacent respectively to the left and right sides thereof to drive a liquid crystal. Therefore, it is possible to display an image with only a data voltage without using a common voltage.

Figure 8:
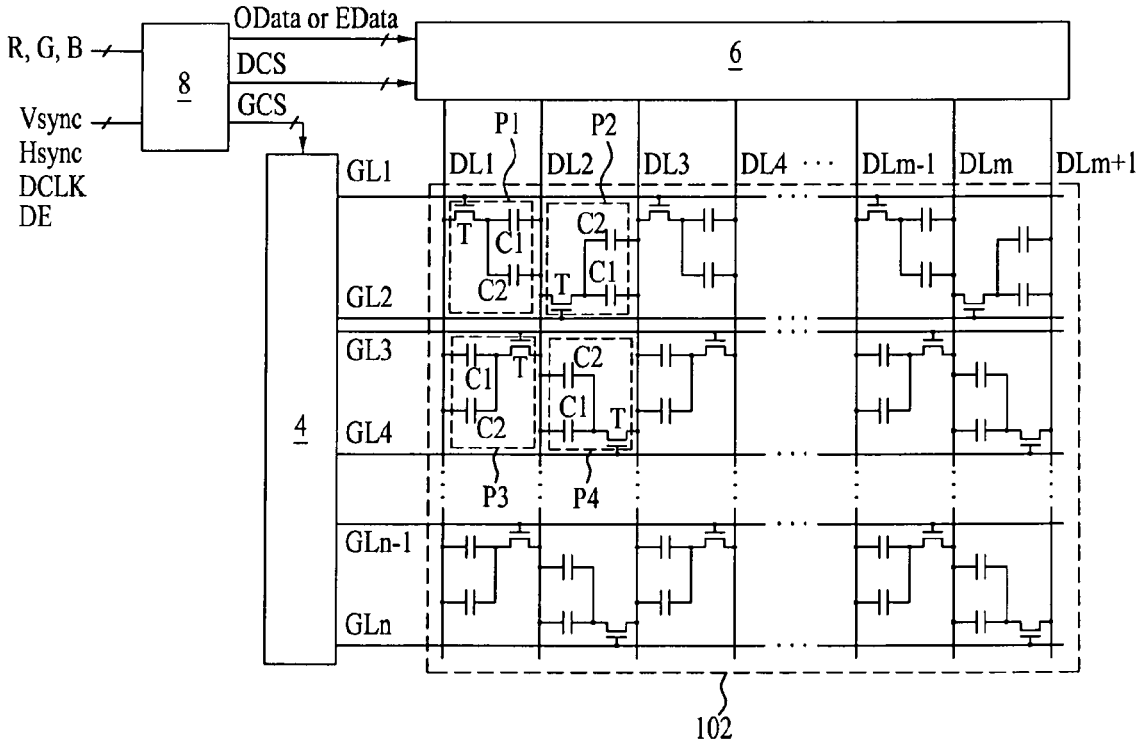
FIG. 8 is a schematic view of a liquid crystal display device according to a second embodiment of the present invention.
Figure 9:
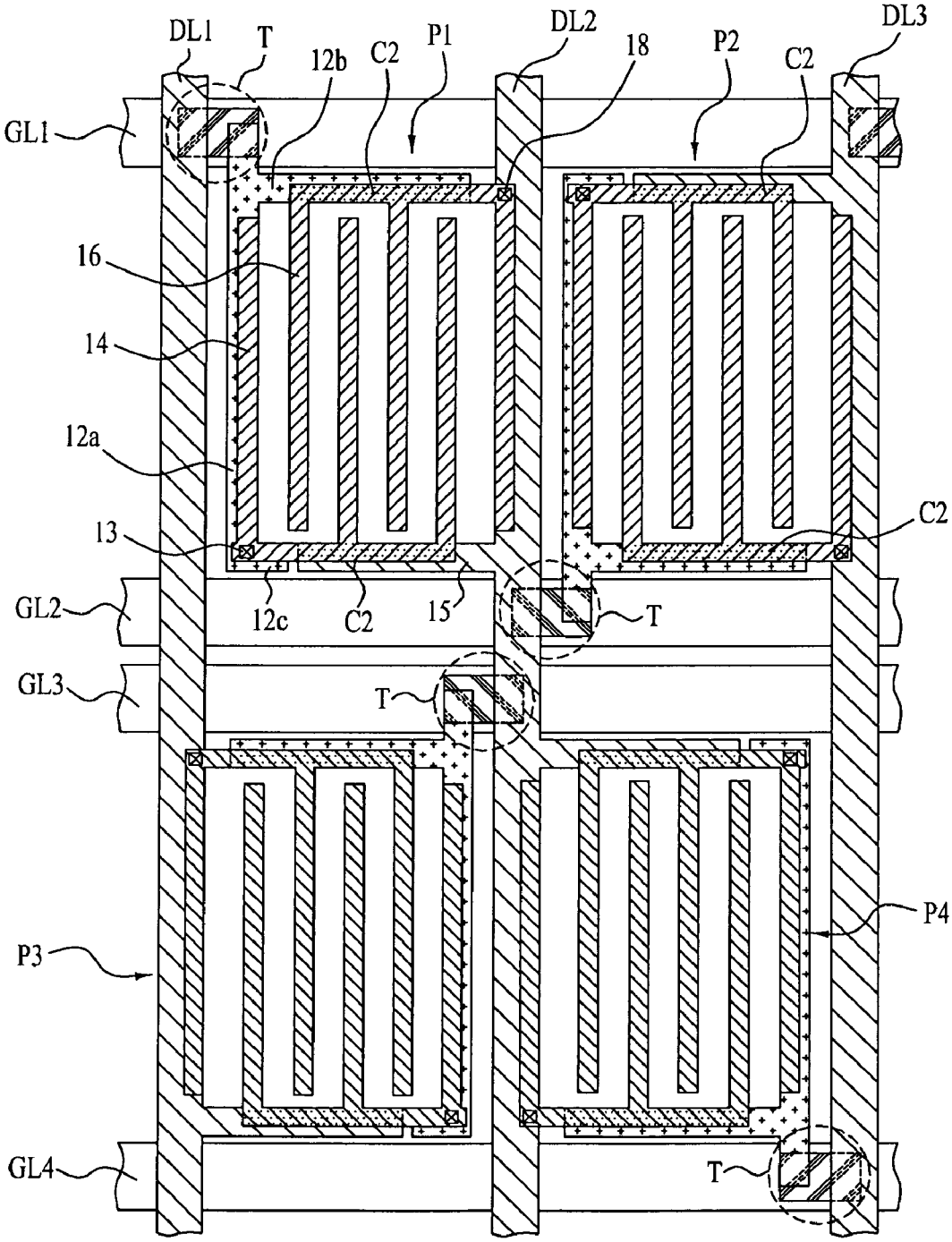
FIG. 9 is a plan view showing a layout of liquid crystal cells formed in an image display panel shown in FIG. 8.

FIG. 8 is a schematic view of a liquid crystal display device according to a second embodiment of the present invention, and FIG. 9 is a plan view showing a layout of liquid crystal cells formed in an image display panel shown in FIG. 8.

Referring to FIGS. 8 and 9, the liquid crystal display device according to the second embodiment of the present invention is the same in configuration as the above-described liquid crystal display device according to the first embodiment of the present invention, with the exception of a connection structure of each liquid crystal cell formed in an image display panel 102. Therefore, a description of the configuration of the liquid crystal display device according to the second embodiment of the present invention, except the connection structure of each liquid crystal cell, will be replaced by the above description of the first embodiment of the present invention.

The thin film transistors T of the liquid crystal cells P of each horizontal line are alternately arranged between two vertically adjacent gate lines, and the thin film transistors T of the liquid crystal cells P of each vertical line are alternately arranged between two horizontally adjacent data lines.

In detail, each of the thin film transistors T of odd ones (referred to hereinafter as a "first liquid crystal cell group") P1 of the liquid crystal cells P of the odd horizontal lines is connected to the (4i-3)th (where i is a natural number smaller than n/4) gate line GL4*i*-3 and a corresponding one of the odd data lines DL1, DL3, DL5, . . . , DLm−1, except the (m+1)th data line DLm+1. Also, each of the thin film transistors T of even ones (referred to hereinafter as a "second liquid crystal cell group") P2 of the liquid crystal cells P of the odd horizontal lines is connected to the (4i-2)th gate line GL4*i*-2 and a corresponding one of the even data lines DL2, DL4, DL6, . . . , DLm. These liquid crystal cells P of the odd horizontal lines have the same connection structures as those of the above-described liquid crystal cells of the first embodiment of the present invention.

Further, each of the thin film transistors T of odd ones (referred to hereinafter as a "third liquid crystal cell group") P3 of the liquid crystal cells P of the even horizontal lines is connected to the (4i-1)th gate line GL4*i*-1 and a corresponding one of the even data lines DL2, DL4, DL6, . . . , DLm.

Further, each of the thin film transistors T of even ones (referred to hereinafter as a "fourth liquid crystal cell group") P4 of the liquid crystal cells P of the even horizontal lines is connected to the (4i)th gate line GL4*i* and a corresponding one of the odd data lines DL3, DL5, . . . , DLm+1, except the first data line DL1.

Each liquid crystal capacitor C1 of the first liquid crystal cell group P1 drives a liquid crystal by forming a horizontal electric field based on a potential difference between a first image signal from a corresponding one of the odd data lines DL1, DL3, DL5, . . . , DLm−1, except the (m+1)th data line DLm+1, and a second image signal from a corresponding one of the even data lines DL2, DL4, DL6, . . . , DLm. At this time, the second image signal which is supplied from each of the even data lines DL2, DL4, DL6, . . . , DLm to the opposite electrode is a reference voltage to drive the first liquid crystal cell group P1. Each storage capacitor C2 of the first liquid crystal cell group P1 stores the potential difference between the first image signal and the second image signal when the first liquid crystal cell group P1 is driven, so as to maintain a voltage stored in each liquid crystal capacitor C1 of the first liquid crystal cell group P1 after the thin film transistor T is turned off.

Each liquid crystal capacitor C1 of the second liquid crystal cell group P2 drives a liquid crystal by forming an electric field based on a potential difference between a first image signal from a corresponding one of the even data lines DL2, DL4, DL6, . . . , DLm and a second image signal from a corresponding one of the odd data lines DL3, DL5, . . . , DLm+1, except the first data line DL1. At this time, the second image signal which is supplied from each of the odd data lines DL3, DL5, . . . , DLm+1, except the first data line DL1, to the opposite electrode is a reference voltage to drive the second liquid crystal cell group P2. Each storage capacitor C2 of the second liquid crystal cell group P2 stores the potential difference between the first image signal and the second image signal when the second liquid crystal cell group P2 is driven, so as to maintain a voltage stored in each liquid crystal capacitor C1 of the second liquid crystal cell group P2 after the thin film transistor T is turned off.

Each liquid crystal capacitor C1 of the third liquid crystal cell group P3 drives a liquid crystal by forming an electric field based on a potential difference between a first image signal from a corresponding one of the even data lines DL2, DL4, DL6, . . . , DLm and a second image signal from a corresponding one of the odd data lines DL1, DL3, DLm−1, except the (m+1)th data line DLm+1. At this time, the second image signal which is supplied from each of the odd data lines DL1, DL3, . . . , DLm−1, except the (m+1)th data line DLm+1, to the opposite electrode is a reference voltage to drive the third liquid crystal cell group P3. Each storage capacitor C2 of the third liquid crystal cell group P3 stores the potential difference between the first image signal and the second image signal when the third liquid crystal cell group P3 is driven, so as to maintain a voltage stored in each liquid crystal capacitor C1 of the third liquid crystal cell group P3 after the thin film transistor T is turned off.

Each liquid crystal capacitor C1 of the fourth liquid crystal cell group P4 drives a liquid crystal by forming a horizontal electric field based on a potential difference between a first image signal from a corresponding one of the odd data lines ('DL1'□□) DL3, DL5, . . . , DLm+1, except the first data line DL1, and a second image signal from a corresponding one of the even data lines DL2, DL4, DL6, . . . , DLm. At this time, the second image signal which is supplied from each of the even data lines DL2, DL4, DL6, . . . , DLm to the opposite electrode is a reference voltage to drive the fourth liquid crystal cell group P4. Each storage capacitor C2 of the fourth liquid crystal cell group P4 stores the potential difference between the first image signal and the second image signal when the fourth liquid crystal cell group P4 is driven, so as to maintain a voltage stored in each liquid crystal capacitor C1 of the fourth liquid crystal cell group P4 after the thin film transistor T is turned off.

FIGS. 10A to 10D are views illustrating the polarities of image signals supplied to the image display panel and the polarities of the liquid crystal cells of the image display panel, in a driving method of the liquid crystal display device according to the second embodiment of the present invention. FIGS. 10A to 10D show only liquid crystal cells to which image signals are supplied.

Figure 10A:
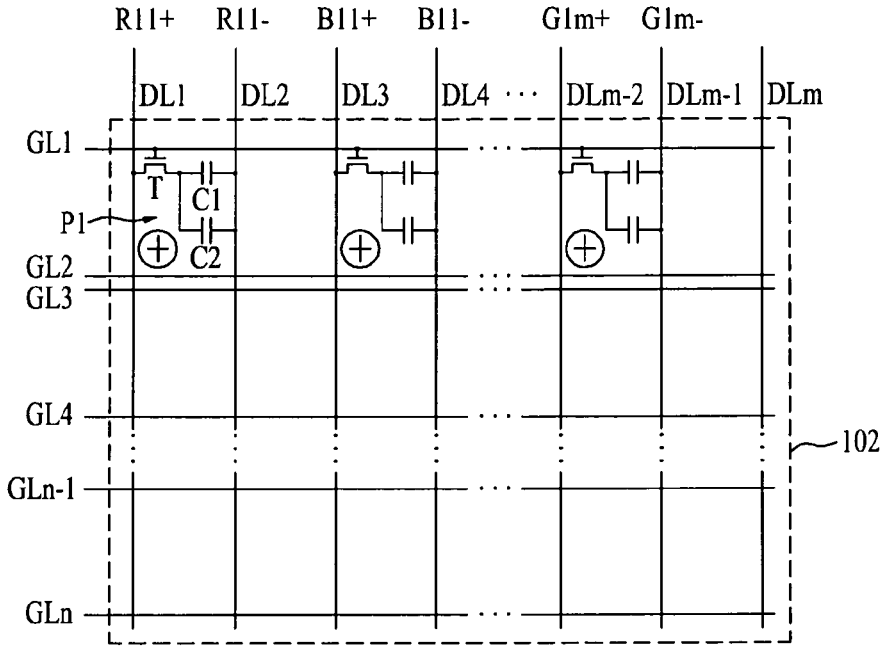
FIGS. 10A to 10D are views illustrating a driving method of the liquid crystal display device according to the second embodiment of the present invention.

First, the gate pulse is supplied to the first gate line GL1 by the gate driving circuit 4. In synchronization with this, the data driving circuit 6 supplies positive (+) first image signals R11+, B11+, . . . , G1*m*+ respectively to the odd data lines DL1, DL3, DL5, . . . , DLm−1, except the (m+1)th data line DLm+1, and supplies negative (−) second image signals R11−, B11−, . . . , G1*m*− respectively to the even data lines DL2, DL4, DL6, . . . , DLm, as shown in FIG. 10A. As a result, each liquid crystal cell of the first liquid crystal cell group P1 of the first horizontal line displays a positive image (+) by driving the liquid crystal with a positive electric field based on a potential difference of the first image signal from the second image signal supplied to the opposite electrode.

Figure 10B:
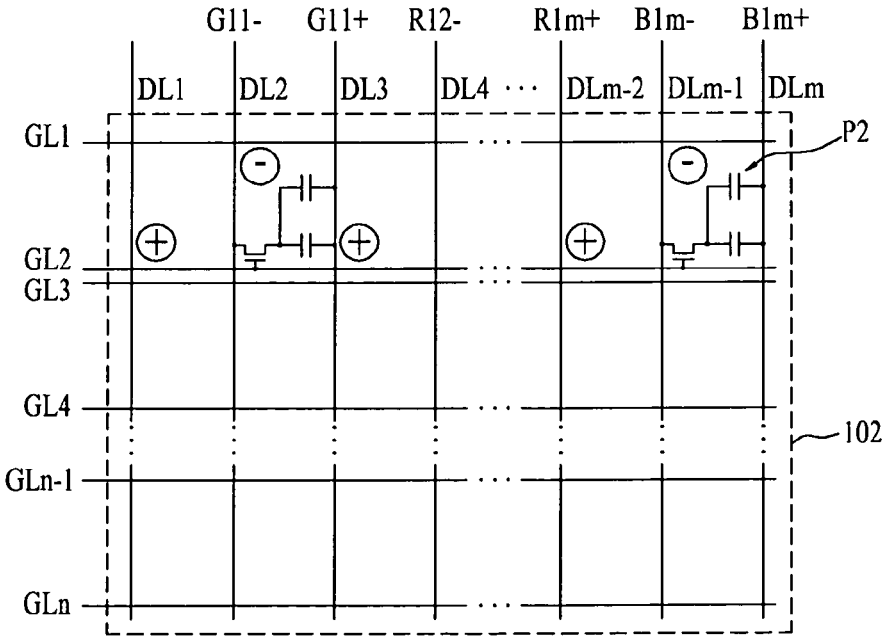

Thereafter, the gate pulse is supplied to the second gate line GL2 by the gate driving circuit 4. In synchronization with this, the data driving circuit 6 supplies negative (−) first image signals G11−, R12−, . . . , B1*m*− respectively to the even data lines DL2, DL4, DL6, . . . , DLm and supplies positive (+) second image signals G11+, R12+, . . . , B1*m*+ respectively to the odd data lines DL3, DL5, . . . , DLm+1, except the first data line DL1, as shown in FIG. 10B. At this time, as described in the first embodiment of the present invention, although the negative (−) first image signals G11−, R12−, . . . , B1*m*− are supplied to the even data lines DL2, DL4, DL6, . . . , DLm, a potential difference charged in each liquid crystal cell P of the first liquid crystal cell group P1 is maintained as it is.

As a result, each liquid crystal cell of the second liquid crystal cell group P2 of the first horizontal line displays a negative image (−) by driving the liquid crystal with a negative electric field based on a potential difference of the first image signal from the second image signal supplied to the opposite electrode.

By displaying a negative image (−) on the second liquid crystal cell group P2 of the first horizontal line based on the driving of the second gate line GL2 after displaying a positive image (+) on the first liquid crystal cell group P1 of the first horizontal line based on the driving of the first gate line GL1, as stated above, the polarities of the liquid crystal cells of the first horizontal line are inverted for every liquid crystal cell. Also, by combining an image displayed on one or some of the liquid crystal cells of the unit pixel by the driving of the first gate line GL1 and an image displayed on the other liquid crystal cells or the other liquid crystal cell of the unit pixel by the driving of the second gate line GL2, a desired image is displayed on the unit pixel.

Figure 10C:
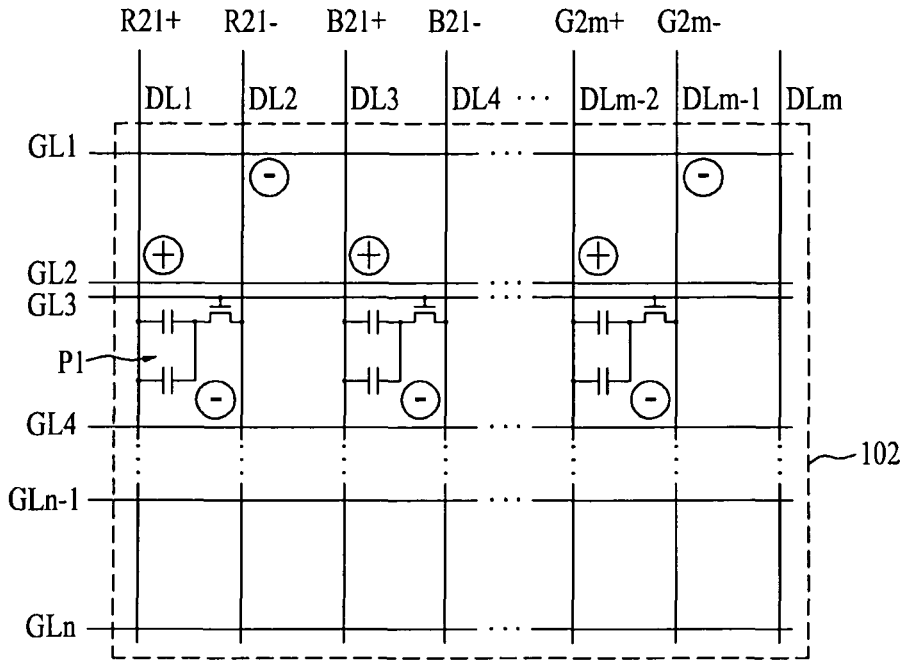

Thereafter, the gate pulse is supplied to the third gate line GL3 by the gate driving circuit 4. In synchronization with this, the data driving circuit 6 supplies negative (−) first image signals R21−, B21−, . . . , G2*m*− respectively to the even data lines DL2, DL4, DL6, . . . , DLm and supplies positive (+) second image signals R21+, B21+, . . . , G2*m*+ respectively to the odd data lines DL1, DL3, DL5, . . . , DLm−1, except the (m+1)th data line DLm+1, as shown in FIG. 10C. As a result, each liquid crystal cell of the third liquid crystal cell group P3 of the second horizontal line displays a negative image (−) by driving the liquid crystal with a negative electric field based on a potential difference of the first image signal from the second image signal supplied to the opposite electrode.

Figure 10D:
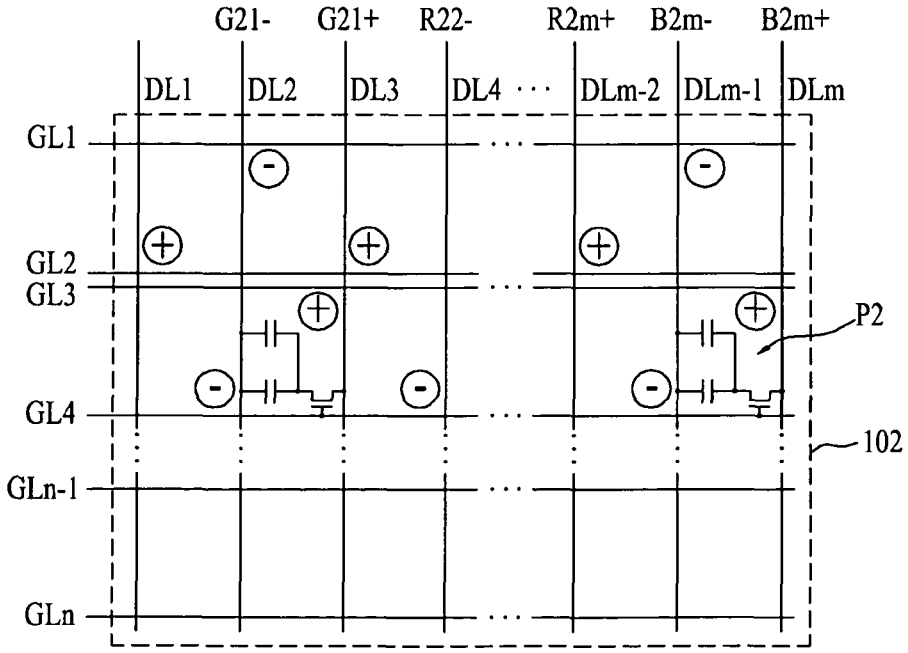

Thereafter, the gate pulse is supplied to the fourth gate line GL4 by the gate driving circuit 4. In synchronization with this, the data driving circuit 6 supplies positive (+) first image signals G21+, R22+, . . . , B2*m*+ respectively to the odd data lines DL3, DL5, . . . , DLm+1, except the first data line DL1, and supplies negative (−) second image signals G21−, R22−, . . . , B2*m*− respectively to the even data lines DL2, DL4, DL6, . . . , DLm, as shown in FIG. 10D. As a result, each liquid crystal cell of the fourth liquid crystal cell group P4 of the second horizontal line displays a positive image (+) by driving the liquid crystal with a positive electric field based on a potential difference of the first image signal from the second image signal supplied to the opposite electrode.

By displaying a positive image (+) on the fourth liquid crystal cell group P4 of the second horizontal line based on the driving of the fourth gate line GL4 after displaying a negative image (−) on the third liquid crystal cell group P3 of the second horizontal line based on the driving of the third gate line GL3, as stated above, the polarities of the liquid crystal cells of the second horizontal line are inverted for every liquid crystal cell and become inverted ones of the polarities of the liquid crystal cells of the first horizontal line. Also, by combining an image displayed on one or some of the liquid crystal cells of the unit pixel by the driving of the third gate line GL3 and an image displayed on the other liquid crystal cells or the other liquid crystal cell of the unit pixel by the driving of the fourth gate line GL4, a desired image is displayed on the unit pixel.

The liquid crystal cells of the remaining horizontal lines corresponding to the fifth to nth gate lines GL5 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, the liquid crystal display device and the driving method thereof according to the second embodiment of the present invention provide the same effects as those of the first embodiment of the present invention, stated previously. Also, in the second embodiment of the present invention, the thin film transistors T of the liquid crystal cells P are alternately arranged in the gate line direction and in the data line direction. Therefore, for display of an image having a polarity pattern based on the 1-dot inversion scheme on the image display panel 102, the polarities of image signals outputted from the data driving circuit 6 are inverted for every data line and for every at least one frame, thereby reducing power consumption of the data driving circuit 6. Of course, the power consumption of the data driving circuit 6 according to the second embodiment of the present invention can be reduced similarly in other inversion schemes, as well as in the 1-dot inversion scheme.

As apparent from the above description, the liquid crystal display device and the driving method thereof according to the present invention have effects as follows.

Firstly, a common voltage supply line for application of a common voltage to an opposite electrode of each liquid crystal cell is not required, thus increasing an aperture ratio of each liquid crystal cell.

Secondly, because first and second image signals symmetrical to each other are supplied to each liquid crystal cell through two adjacent data lines, occurrence of a horizontal crosstalk can be eliminated. In addition, it is possible to eliminate occurrence of a flicker resulting from a DC component and prevent a liquid crystal from being deteriorated.

Thirdly, the polarity of an image signal to the opposite electrode of each liquid crystal cell is inverted based on an inversion scheme to correspond to a gate line driving frequency. Therefore, it is possible to eliminate occurrence of an afterimage resulting from the polarity inversion of the image signal, so as to prevent a picture quality from being degraded.

Fourthly, an image is provided based on the first and second image signals symmetrical to each other. Therefore, the swing width of each image signal can be reduced, thus reducing the amount of heat to be generated in a data driving circuit and the amount of current to be consumed therein. Further, it is possible to drive the liquid crystal with a high voltage, so as to increase a response speed of the liquid crystal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device having a plurality of liquid crystal cells formed respectively in pixel areas defined by crossings of a plurality of gate lines and a plurality of data lines, wherein each of the liquid crystal cells comprises:

a thin film transistor connected to an adjacent one of the gate lines and an adjacent one of the data lines; and a liquid crystal capacitor and a storage capacitor connected between an adjacent another data line and the thin film transistor, wherein the liquid crystal capacitor and the storage capacitor connect with the adjacent data line through the thin film transistor and directly connect with the adjacent another data line, wherein the liquid crystal cells are arranged on a plurality of horizontal lines and a plurality of vertical lines, wherein the thin film transistors of the liquid crystal cells on each of the horizontal lines are alternately connected to two adjacent ones of the gate lines along a horizontal direction of the two adjacent gate lines, and wherein the thin film transistors of the liquid crystal cells on each of the vertical lines are alternately connected to two adjacent ones of the data lines along a vertical direction of the two adjacent data lines.

2. A liquid crystal display device having a plurality of liquid crystal cells formed respectively in pixel areas defined by crossings of a plurality of gate lines and a plurality of data lines, wherein each of the liquid crystal cells comprises:

a thin film transistor connected to an adjacent gate line of the plurality of gate lines and an adjacent data line of the plurality of data lines, and a liquid crystal capacitor and a storage capacitor connected between an adjacent another data line of the plurality of data lines and the thin film transistor, wherein the liquid crystal capacitor and the storage capacitor connect with the adjacent data line through the thin film transistor and directly connect with the adjacent another data line, wherein one unit pixel is constituted by every first to third ones of the liquid crystal cells, arranged adjacent to one another in a direction of the gate lines, wherein any one of the liquid crystal cells of the unit pixel is connected to the gate line different from an adjacent another gate line to which the other liquid crystal cells of the unit pixel are connected, wherein the liquid crystal cells are arranged on a plurality of horizontal lines and a plurality of vertical lines, wherein the thin film transistors of odd liquid crystal cells on each of the vertical lines are connected to one of the two adjacent data lines and the thin film transistors of even liquid crystal cells on each vertical line are connected to another one of the two adjacent data lines.

3. The liquid crystal display device according to claim 2, wherein each of the liquid crystal cells comprises:

a pixel electrode connected to the thin film transistor;

an opposite electrode connected to the adjacent another data line, wherein the liquid crystal capacitor is formed by a liquid crystal layer between the pixel electrode and the opposite electrode and the storage capacitor is formed by an overlap of the pixel electrode and the opposite electrode.

4. The liquid crystal display device according to claim 3, wherein the thin film transistor of the liquid crystal cells on each of the horizontal lines are alternately connected to two adjacent ones of the gate lines along a horizontal direction of the two adjacent gate lines.

5. A liquid crystal display device comprising:

an image display panel including a plurality of liquid crystal cells formed respectively in pixel areas defined by crossings of a plurality of gate lines and a plurality of data lines, each of the liquid crystal cells being driven by first and second image signals supplied respectively to two adjacent data lines of the data lines, wherein each of the liquid crystal cells comprises a thin film transistor connected to an adjacent gate line of the gate lines and an adjacent data line of the data lines, and a liquid crystal capacitor and a storage capacitor connected between an adjacent another data line and the thin film transistor, wherein the liquid crystal capacitor and the storage capacitor connect with the adjacent data line through the thin film transistor and directly connect with the adjacent another data line;

a gate driving circuit for driving the gate lines;

a data driving circuit for converting the same data into the first and second image signals, the first and second image signals having voltage levels symmetrical to each other, and supplying the converted first and second image signals to each of the liquid crystal cells, respectively, through the two adjacent data lines; and a timing controller for controlling the gate driving circuit and the data driving circuit and supplying the data corresponding to the first and second image signals to the data driving circuit, wherein the first and second image signals are symmetrical about a middle voltage between a lowest voltage and a highest voltage, wherein the liquid crystal cells are arranged on a plurality of horizontal lines and a plurality of vertical lines, wherein the thin film transistors of the liquid crystal cells on each of the horizontal lines are alternately connected to two adjacent ones of the gate lines along a horizontal direction of the two adjacent gate lines, wherein the thin film transistors of the liquid crystal cells on each of the vertical lines are alternately connected to the two adjacent data lines along a vertical direction of the two adjacent data lines, and wherein image signals, supplied from the data driving circuit to each of the data lines for at least one frame, have the same polarity and have the different polarity from image signals supplied to a data line adjacent to the each data line.

6. The liquid crystal display device according to claim 5, wherein each of the liquid crystal cells comprises:

a pixel electrode connected to the thin film transistor;

an opposite electrode connected to the adjacent another data line, wherein the liquid crystal capacitor is formed by a liquid crystal layer between the pixel electrode and the opposite electrode and the storage capacitor is formed by an overlap of the pixel electrode and the opposite electrode.

7. The liquid crystal display device according to any one of claims 1, 4 and 5, wherein each of the data lines, except a first data line and a last data line, is connected in common to two adjacent ones of the liquid crystal cells.

8. The liquid crystal display device according to claim 7, wherein each of the horizontal lines comprises:

a first liquid crystal cell group including the liquid crystal cells connected to a corresponding odd one of the gate lines; and a second liquid crystal cell group including the liquid crystal cells connected to a corresponding even one of the gate lines.

9. The liquid crystal display device according to any one of claims 1, 4 and 5, wherein each of the data lines, except a first data line and a last data line, is connected in common to two adjacent ones of the liquid crystal cells.

10. The liquid crystal display device according to claim 9, wherein each odd one of the horizontal lines comprises:

a first liquid crystal cell group including the liquid crystal cells connected to a (4i-3)th (where i is a natural number smaller than a total number of the gate lines) one of the gate lines; and a second liquid crystal cell group including the liquid crystal cells connected to a (4i-2)th one of the gate lines, wherein each even one of the horizontal lines comprises:

a third liquid crystal cell group including the liquid crystal cells connected to a (4i-1)th one of the gate lines; and a fourth liquid crystal cell group including the liquid crystal cells connected to a (4i)th one of the gate lines.

11. The liquid crystal display device according to claim 5, wherein the data driving circuit samples the data, and converts the sampled data into any one of the first and second image signals having a voltage level higher than the middle voltage and the other one of the first and second image signals having a voltage level lower than the middle voltage in response to a polarity control signal.

12. A method for driving a liquid crystal display device, the liquid crystal display device having a plurality of liquid crystal cells formed respectively in pixel areas defined by intersections of a plurality of gate lines and a plurality of data lines, the method comprising:

sequentially driving the gate lines;

converting the same data into first and second image signals, the first and second image signals being symmetrical about a middle voltage between a lowest voltage and a highest voltage; and supplying the first and second image signals to each of the liquid crystal cells, respectively, through two adjacent data lines of the data lines, synchronously with the driving of a corresponding one of the gate lines, wherein each of the liquid crystal cells comprises:

a thin film transistor connected to an adjacent gate line and an adjacent data line, and a liquid crystal capacitor and a storage capacitor connected between an adjacent another data line and the thin film transistor, wherein the liquid crystal capacitor and the storage capacitor connect with the adjacent data line through the thin film transistor and directly connect with the adjacent another data line, wherein the liquid crystal cells are arranged on a plurality of horizontal lines and a plurality of vertical lines, wherein the thin film transistor of the liquid crystal cells on each of the vertical lines are alternately connected to two adjacent ones of the data lines along a vertical direction of the two adjacent data lines, and wherein image signals, supplied to each of the data lines for at least one frame, have the same polarity and have the different polarity from image signals supplied to a data line adjacent to the each data line.

13. A method for driving a liquid crystal display device, the liquid crystal display device having a plurality of liquid crystal cells formed respectively in pixel areas defined by intersections of a plurality of gate lines and a plurality of data lines, one unit pixel being constituted by every first to third ones of the liquid crystal cells, arranged adjacent to one another in a direction of the gate lines, the method comprising:

sequentially driving the gate lines;

converting the same data into first and second image signals, the first and second image signals being symmetrical about a middle voltage between a lowest voltage and a highest voltage; and supplying the first and second image signals to each of one or some of the liquid crystal cells of the unit pixel, respectively, through the adjacent two data lines synchronously with the driving of a first one of adjacent two gate lines, and supplying the first and second image signals to each of the other liquid crystal cells or the other liquid crystal cell of the unit pixel, respectively, through the two adjacent data lines synchronously with the driving of a second one of the two adjacent gate lines, wherein each of the liquid crystal cells comprises:

a thin film transistor connected to an adjacent gate line and an adjacent data line, and a liquid crystal capacitor and a storage capacitor connected between an adjacent another data line and the thin film transistor, wherein the liquid crystal capacitor and the storage capacitor connect with the adjacent data line through the thin film transistor and directly connect with the adjacent another data line, wherein the liquid crystal cells are arranged on a plurality of horizontal lines and a plurality of vertical lines, wherein thin film transistors of the liquid crystal cells on each of the horizontal lines are alternately connected to two adjacent ones of the gate lines along a horizontal direction of the two adjacent gate lines, wherein the thin film transistor of the liquid crystal cells on each of the vertical lines are alternately connected to two adjacent ones of the data lines along a vertical direction of the two adjacent data lines, and wherein image signals, supplied to each of the data lines for at least one frame, have the same polarity and have the different polarity from image signals supplied to a data line adjacent to the each data line.

14. The method according to claim 12 or 13, wherein the step of converting comprises:

generating a plurality of positive gamma voltages having different voltage levels higher than the middle voltage;

generating a plurality of negative gamma voltages having different voltage levels lower than the middle voltage, the negative gamma voltages being symmetrical to the positive gamma voltages with respect to the middle voltage;

sampling the data; and converting the sampled data into the first and second image signals in response to a polarity control signal using the positive gamma voltages and the negative gamma voltages.

15. The method according to claim 12, wherein the step of supplying comprises:

supplying the first and second image signals to each of odd ones of the liquid crystal cells on the each horizontal line, respectively, through the two adjacent data lines synchronously with the driving of a corresponding odd one of the gate lines; and supplying the first and second image signals to each of even ones of the liquid crystal cells on the each horizontal line, respectively, through the two adjacent data lines synchronously with the driving of a corresponding even one of the gate lines.

16. The method according to claim 12, wherein the step of supplying comprises:

supplying the first and second image signals to each of odd ones of the liquid crystal cells on each odd horizontal line, respectively, through a thin film transistor connected to a (4i-3)th (where i is a natural number smaller than a total number of the gate lines) one of the gate lines and to an odd one of the two adjacent data lines, and an even one of the two adjacent data lines;

supplying the first and second image signals to each of even ones of the liquid crystal cells on each odd horizontal line, respectively, through a thin film transistor connected to a (4i-2)th one of the gate lines and to the odd data line, and the even data line;

supplying the first and second image signals to each of odd ones of the liquid crystal cells on each even horizontal line, respectively, through a thin film transistor connected to a (4i-1)th one of the gate lines and to the even data line, and the odd data line; and supplying the first and second image signals to each of even ones of the liquid crystal cells on each even horizontal line, respectively, through a thin film transistor connected to a (4i)th one of the gate lines and to the even data line, and the odd data line.

17. The method according to claim 13, wherein the step of supplying comprises:

supplying the first and second image signals to odd ones of the liquid crystal cells on each horizontal line synchronously with the driving of the first gate line; and supplying the first and second image signals to even ones of the liquid crystal cells on each horizontal line synchronously with the driving of the second gate line.

18. The method according to claim 13, wherein the step of supplying comprises:

supplying the first and second image signals to each of odd ones of the liquid crystal cells on each odd horizontal line, respectively, through a thin film transistor connected to the first gate line and to an odd one of the two adjacent data lines, and an even one of the two adjacent data lines;

supplying the first and second image signals to each of even ones of the liquid crystal cells on each odd horizontal line, respectively, through a thin film transistor connected to the second gate line and to the odd data line, and the even data line;

supplying the first and second image signals to each of odd ones of the liquid crystal cells on each even horizontal line, respectively, through a thin film transistor connected to a third gate line and to the even data line, and the odd data line; and supplying the first and second image signals to each of even ones of the liquid crystal cells on each even horizontal line, respectively, through a thin film transistor connected to a fourth gate line and to the even data line, and the odd data line.

* * * * *